US007677872B2

(12) United States Patent
Beardmore

(10) Patent No.: US 7,677,872 B2
(45) Date of Patent: Mar. 16, 2010

(54) LOW BACK-FLOW PULSATION FUEL INJECTION PUMP

(75) Inventor: John M. Beardmore, Howell, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/949,854

(22) Filed: Dec. 4, 2007

(65) Prior Publication Data

US 2009/0068041 A1 Mar. 12, 2009

Related U.S. Application Data

(60) Provisional application No. 60/970,572, filed on Sep. 7, 2007.

(51) Int. Cl.
*F04B 23/04* (2006.01)

(52) U.S. Cl. ..... 417/569; 417/521; 417/307; 417/534

(58) Field of Classification Search ..... 417/569, 417/540, 542, 245, 521, 534, 307; 123/446, 123/447, 495, 506, 508
See application file for complete search history.

(56) References Cited

U.S. PATENT DOCUMENTS

| | | | | |
|---|---|---|---|---|
| 5,540,206 | A * | 7/1996 | Heimberg | 123/497 |
| 6,053,712 | A | 4/2000 | Konishi et al. | |
| 6,253,734 | B1 * | 7/2001 | Rembold et al. | 123/446 |
| 2002/0062817 | A1 * | 5/2002 | Endo | 123/467 |
| 2006/0196476 | A1 * | 9/2006 | Stockner | 123/457 |

* cited by examiner

*Primary Examiner*—Devon C Kramer
*Assistant Examiner*—Todd D Jacobs
(74) *Attorney, Agent, or Firm*—Quinn Law Group, PLLC

(57) ABSTRACT

A fuel pump assembly includes a pump bushing defining a dual-chambered pumping cavity, a fluid channel for shuttling fuel between the chambers, a plunger, and a plurality of fluid control valves. A first check valve is a pressure relief valve in fluid communication with an outlet of the pump bushing and with either an inlet of a second check valve or an inlet of the pump bushing. Another check valve or a control orifice may be used in parallel with the second check valve, with the third check valve or control orifice being positioned at least partially external to the fuel pump assembly. A vehicle includes a transmission, engine, a returnless high-pressure fuel pump assembly, and a low-pressure fuel line in fluid communication with an inlet side of an inlet control valve. The high-pressure fuel pump assembly inhibits a pressure pulsation from propagating through the low-pressure fuel line.

18 Claims, 4 Drawing Sheets

LOW BACK-FLOW PULSATION FUEL INJECTION PUMP

CLAIM OF PRIORITY

This application claims priority to U.S. Provisional Patent Application No. 60/970,572, filed on Sep. 7, 2007, which is hereby incorporated by reference in its entirety.

TECHNICAL FIELD

The present invention relates to a high-pressure fuel injection pump assembly, and in particular to a returnless high-pressure (HP) fuel pump assembly that is configured for inhibiting propagation of a pressure pulsation from a pump bushing to a low-pressure fuel line, the pressure pulsation resulting from a pressurization stroke or phase of the HP fuel pump assembly.

BACKGROUND OF THE INVENTION

Fuel pumps for vehicles rapidly pressurize an amount of fuel delivered or drawn from a low-pressure fuel supply, such as a tank or reservoir, to a fuel delivery system for an internal combustion engine. Depending on the type of fuel delivery system used, i.e. a carburetor, a throttle body injection system, a port injection system, or a direct fuel injection system, the fuel may be delivered to or directed into the engine under relatively low- or high-pressure. For example, a fuel injection system typically requires fuel to be delivered at much higher pressures than does a carburetor. High-pressure (HP) fuel pump assemblies used with Spark Ignition Direct Injection (SIDI) engines in particular typically utilize fuel rail pressures of approximately 150 to 200 bar, Combustible fuel may be pressurized to a sufficiently high level of pressure using a high-pressure (HP) fuel pump system or assembly. Such a HP fuel pump assembly typically operates as a demand-style pump assembly, i.e. a pump assembly having an output pressure and flow rate that vary in accordance with certain engine operating parameters such as load, speed, and/or temperature. Demand-style pump assemblies may be configured as either a "return" or a "returnless" design, depending on the respective presence or absence of a dedicated or separate fuel return line. That is, a returnless fuel pump assembly is characterized by the presence of a fuel feed line for delivering fuel to a portion of a pumping chamber within a pump bushing, and also by the absence of a dedicated fuel return line for returning an amount of unused fuel from the pumping cavity back to the tank/reservoir.

SUMMARY OF THE INVENTION

Accordingly, a returnless fuel pump assembly is provided having a plunger and a pump bushing, which together define a dual-chambered pumping cavity that is in fluid communication with a low-pressure supply of fluid. A fluid channel connects the two chambers of the pumping cavity to allow unused fluid to shuttle between the two chambers, thereby isolating a pressure pulsation occurring during a pressurization stroke of the fuel pump assembly. The fuel pump assembly has a plurality of fluid control valves, at least one of which is a check valve for containing the pressure pulsation within the pump bushing.

In one aspect of the invention, the fluid control valves include a check valve having an inlet side that is in fluid communication with the supply of fluid, and an outlet side that is in fluid communication with the dual-chambered pumping cavity.

In another aspect of the invention, a pressure relief valve is in fluid communication with an outlet port of the pump bushing and an inlet side of the check valve, with the pressure relief valve configured for opening in response to a threshold pressure of approximately, but not limited to, 200 to 225 bar in one embodiment.

In another aspect of the invention, the fuel pump assembly includes a second pressure relief valve having a flow path that is parallel to a flow path of the check valve.

In another aspect of the invention, the fuel pump assembly includes a control orifice of approximately, but not limited to, 0.4 to 0.6 millimeters in one embodiment, and having a flow path that is parallel to a flow path of the check valve.

In another aspect of the invention, a double-acting, returnless fuel pump assembly includes a pump bushing defining a dual-chambered pumping cavity, and a plunger having a primary axis. The plunger moves within the pumping cavity in response to a motion of an engine component, with movement of the plunger in one direction admitting an amount of low-pressure fuel from a reservoir into a first chamber of the pumping cavity, and movement of the plunger in another direction pressurizing the admitted fuel. A controllable solenoid valve admits the low-pressure fuel into the first chamber. An inlet side of a first check valve is in fluid communication with an outlet port of the pump bushing, and is configured as a pressure relief valve. An inlet side of a second check valve is in fluid communication with the reservoir, and an outlet side of the second check valve is in fluid communication with an inlet side of the controllable solenoid valve.

In another aspect of the invention, an outlet side of the first check valve is in fluid communication with one of an outlet side of the controllable solenoid valve and an inlet side of the second check valve.

In another aspect of the invention, a third check valve is positioned in parallel with the second check valve, and has an outlet side that is in fluid communication with the reservoir, as well as an inlet side that is in fluid communication with an inlet side of the controllable solenoid valve.

In another aspect of the invention, the second check valve and the third check valve are positioned at least partially externally to the pump bushing.

In another aspect of the invention, a control orifice is positioned in parallel with the second check valve, between the reservoir and an inlet side of the controllable solenoid valve.

In another aspect of the invention, a vehicle includes a transmission, an engine connected to the transmission for combusting a pressurized supply of fuel for powering the vehicle, and a high-pressure fuel rail for injecting the pressurized supply of fuel into the engine. The vehicle also includes a HP fuel pump assembly for pressurizing an amount of low-pressure fuel, the HP fuel pump assembly having a plunger and an inlet control valve. A low-pressure fuel line is in fluid communication with an inlet side of the inlet control valve and a low-pressure fuel supply, with the HP fuel pump assembly inhibiting a pressure pulsation from a pressurization stroke of the plunger from propagating through the low-pressure fuel line.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
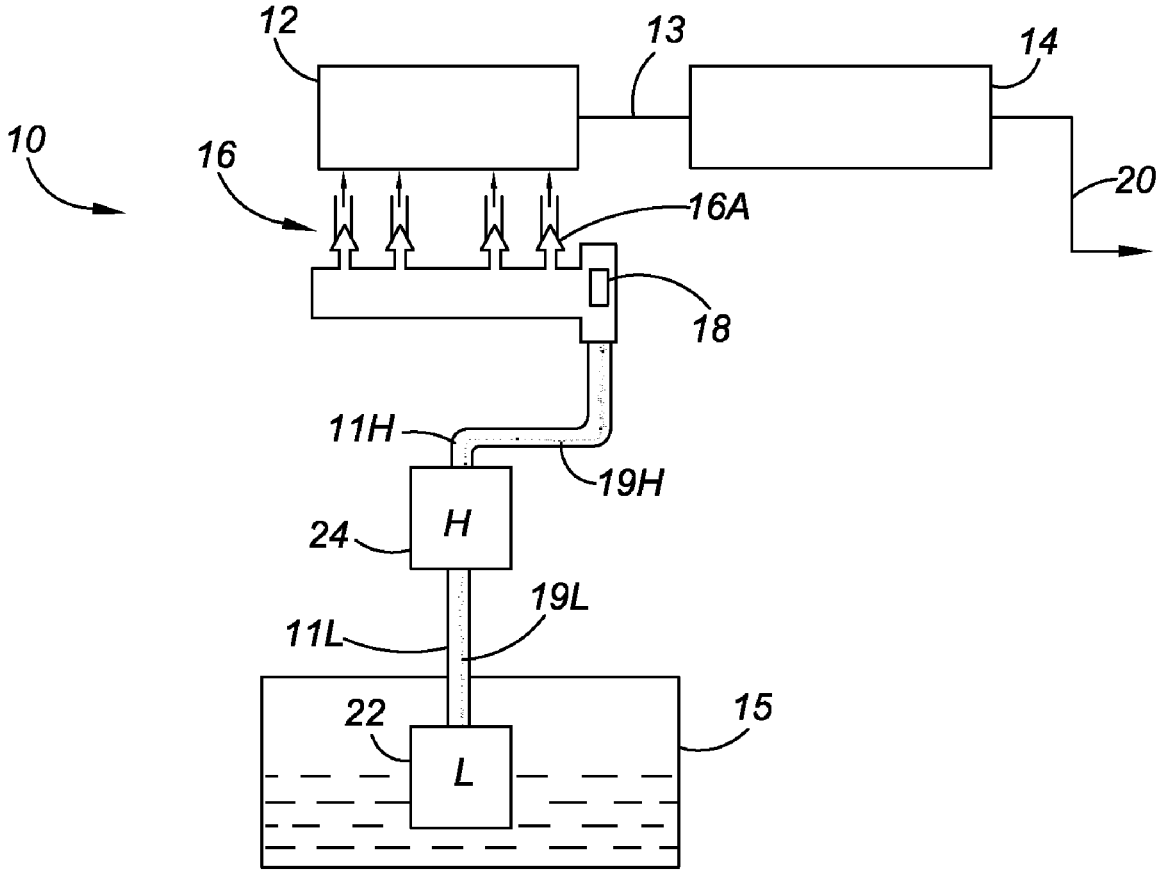
FIG. 1 is a schematic illustration of a vehicle having a combustion engine and a high-pressure (HP) fuel pump assembly of the invention.

Referring to the drawings, wherein like reference numbers correspond to like or similar components throughout the several figures, and beginning with FIG. 1, a vehicle 10 has an engine 12 in driving connection with a transmission 14. The transmission 14 has an input member 13 for receiving power from the engine 12, and an output member 20 that is connected to a plurality of wheels (not shown). The engine 12 may be configured as a Spark Ignition Direct Injection (SIDI) engine, a diesel engine, or another engine utilizing a high-pressure supply of combustible fuel, the operation of which are known to those skilled in the art.

The vehicle 10 includes a low-pressure fuel supply, reservoir, or tank 15 containing a low-pressure amount of combustible fuel 19L, with the character "L" representing relatively low-pressure throughout the various Figures. A supply pump 22, also labeled "L" in FIG. 1 to represent low pressure, is positioned within the tank 15 and is operable for pressurizing the fuel 19L to approximately 4 to 6 bar, or to any other pressure level that is sufficient for moving the fuel 19L from the tank 15 to a high-pressure (HP) fuel pump assembly 24, with the character "H" used in the various Figures to represent high-pressure. A low-pressure fuel line 11L, such as tubing, piping, or other such fluid conduit, is connected between the supply pump 22 and the HP fuel pump assembly 24 to allow the fuel 19L to pass or flow therebetween.

The HP fuel pump assembly 24 is operable for rapidly pressurizing the fuel 19L to at least approximately 150 to 200 bar in one embodiment, although lower pressures are usable within the scope of the invention, and for delivering the pressurized fuel 19H to a fuel rail 16 through a high-pressure fuel line 11H, and ultimately to a fuel delivery device, such as a plurality of fuel injectors 16A. The pressurized fuel 19H is directly injected into various combustion chambers (not shown) of the engine 12 via the fuel injectors 16A, with the fuel rail 16 having at least one pressure sensor 18 operatively connected thereto and configured for sensing a fuel pressure at or in proximity to the fuel rail 16. An electronic control unit or controller 17 is in electronic communication with the engine 12, the fuel rail 16, the supply pump 22, and the HP fuel pump assembly 24, and enables the control and/or synchronization of the various fuel delivery components described herein.

Figure 2:
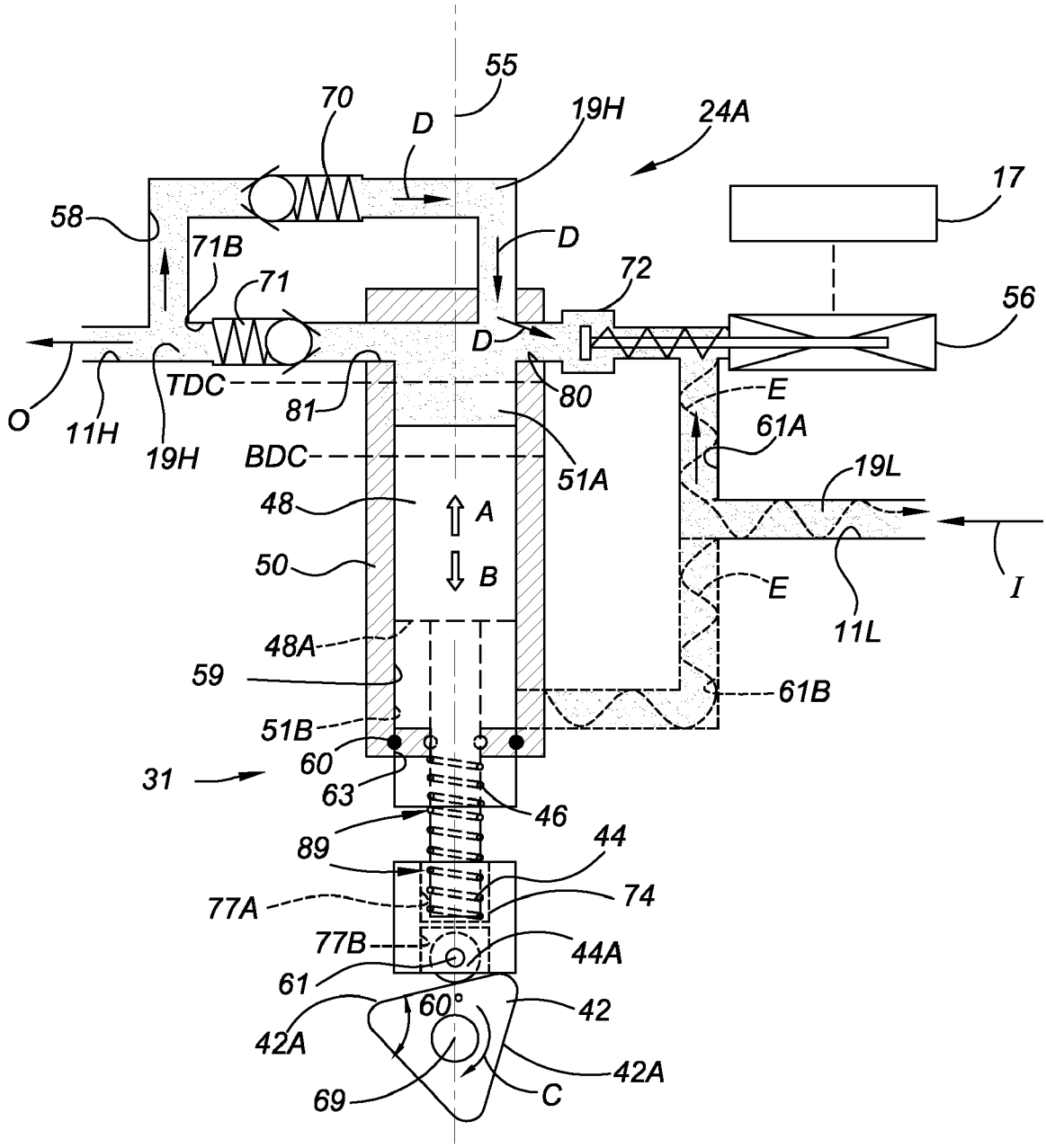
FIG. 2 is a schematic cross sectional illustration of a portion of a representative HP fuel pump assembly having back-pressure pulsations.

Referring now to FIG. 2, a cross-sectional view of a representative HP fuel pump assembly 24A is shown for baseline or illustrative purposes. FIG. 2 describes a HP fuel pump assembly of a returnless design having back-flow pulsations resulting from a pressurization stroke, the elimination, minimization, or containment of these pulsations being an object of the present invention. Unless otherwise specified, the various numbered components of the HP fuel pump assembly 24A are also used with the HP fuel pump assembly 24 of the invention, as will be described later hereinbelow with reference to FIGS. 3, 4, and 4A.

The HP fuel pump assembly 24A includes an electro-mechanical solenoid device or a solenoid 56 operatively connected to and selectively controllable by controller 17. The solenoid 56 is a normally-open device, although a normally-closed solenoid or other controllable electro-mechanical device is also usable within the scope of the invention. The HP pump assembly 24A is thus operable for discharging an amount of pressurized fuel 19H into a respective fuel rail and injector 16 and 16A (see FIG. 1) only when the inlet valve 72 remains closed when the solenoid 56 is a normally-open device, or only when the inlet valve 72 remains open if solenoid 56 is alternately configured as a normally-open device.

The HP fuel pump assembly 24A includes a cylinder or pump bushing 50. The HP fuel pump assembly 24A further includes a piston or plunger 48, a plunger shaft 46, a cam follower 44, and various interconnecting fluid channels, as will be described hereinbelow. The HP fuel pump assembly 24A is shown schematically in the various figures for clarity, and therefore the interconnected fluid channels described herein may be sized and/or routed with respect to the pump bushing 50 as needed in order to make the most efficient use of available material space within the HP fuel pump assembly 24A.

The pump bushing 50 may be constructed of a high-strength material, such as stainless steel or another suitable metal or alloy, and has a continuous cylindrical inner wall 59 at least partially defining an upper pumping or pressure chamber 51A. The plunger 48 is cylindrical in shape, and is disposed within the cylindrical inner wall 59 of the pump bushing 50. The plunger 48 slides or moves in the direction of arrows A in response to a force applied by an engine component, such as a cam portion 42, with motion in the direction of arrow A describing a pressurization stroke or "upstroke" of the HP fuel pump assembly 24A. Motion in the direction of arrow B is provided by a return spring 89 disposed between a lower portion 31 of the pump bushing 50 and a floor 74 of the cam follower 44, which will be described later hereinbelow. Sealing of the plunger 48 within the pump bushing 50 relies on a high precision fit, i.e. approximately 2-3 microns of clearance, such that no additional seals are required for that purpose.

The plunger 48 may be operatively connected to or formed integrally with the plunger shaft 46, which is positioned concentrically within and passes through an opening 63 formed in lower portion 31 of the pump bushing 50. A seal 60, such as an o-ring or other suitable fluid seal, is positioned to prevent fluid bypass through the opening 63. The HP fuel pump assembly 24A is configured as a returnless pump, as described previously hereinabove, and may be configured as either a single-action pump or a double-action pump, with the double-action pump version shown in phantom.

The plunger shaft 46 is operatively connected to, or in continuous contact or engagement with, the cam follower 44. A wheel, drum, or roller 44A is operatively connected to cam follower 44 using a connecting pin or rod 61. The cam follower 44 is generally cylindrical piece of metal or other sufficiently rugged material in continuous rolling contact with an external surface 42A of a cam portion 42. Cam portion 42 has an upper cavity 77A positioned opposite a lower cavity 77B, with the floor 74 positioned therebetween to separate the two cavities 77A, 77B. The plunger 48 is positioned at least partially within the upper cavity 77A, with the roller 44A positioned at least partially within the lower cavity 77B.

Figure 3:
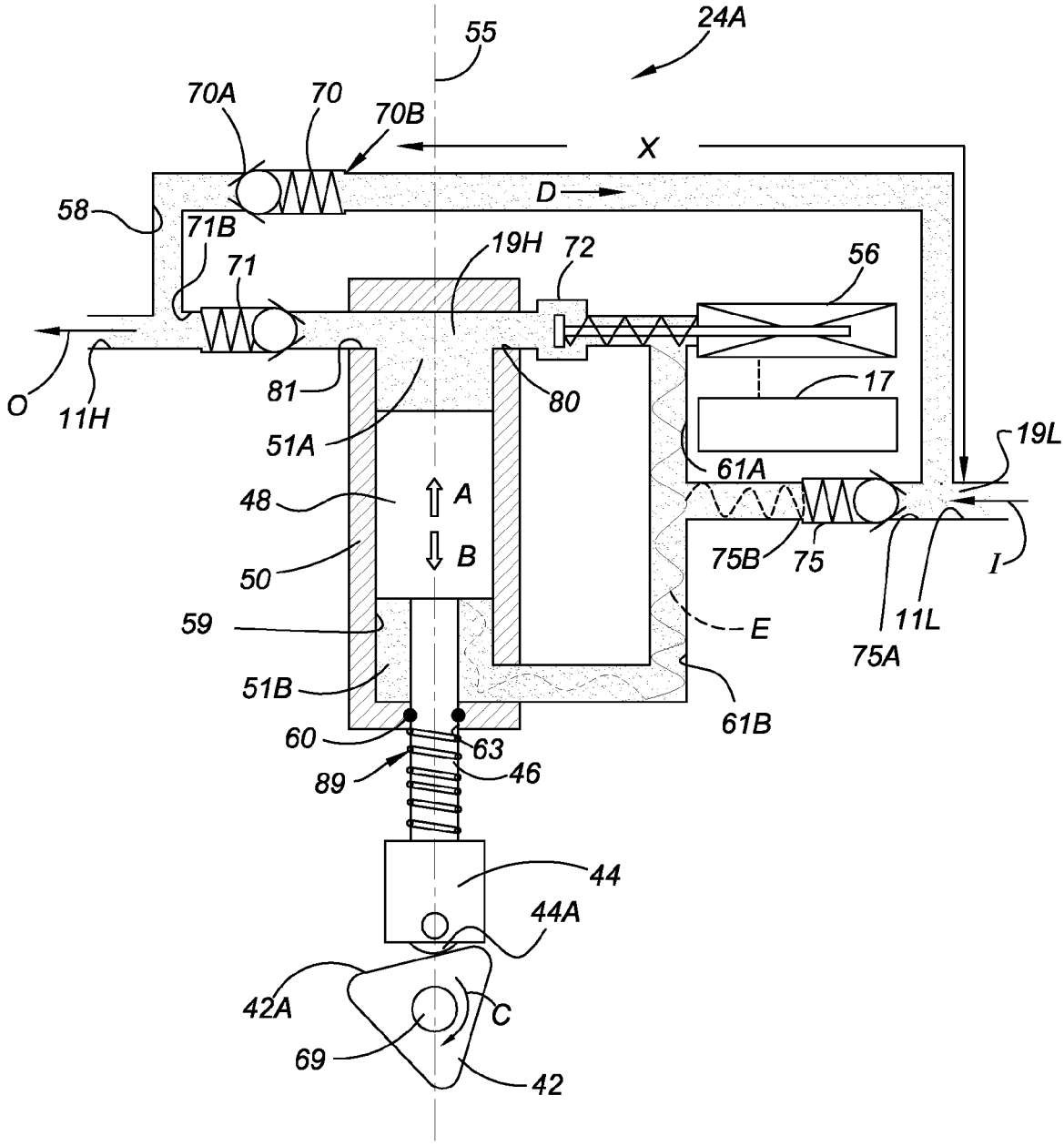
FIG. 3 is a schematic cross sectional illustration of a HP fuel pump assembly according to the invention.
Figure 4:
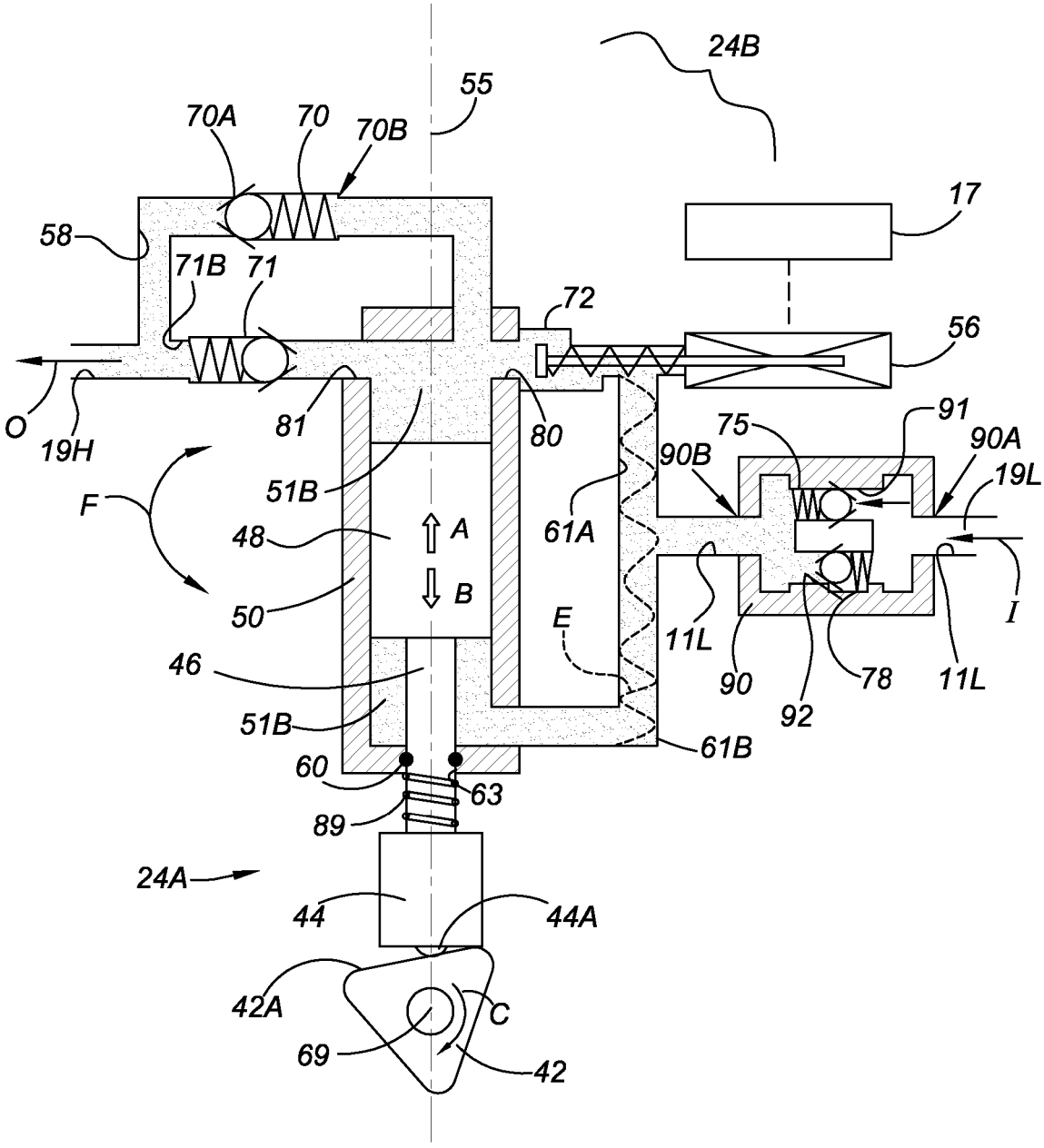
FIG. 4 is a fragmentary cross sectional illustration of an alternate HP fuel pump assembly.

The cam portion 42 may be a 1, 2, 3, or 4 lobe configuration, with each lobe either symmetrically or asymmetrically configured to provide a desired stroke of the plunger 48. As shown in FIGS. 2, 3, and 4, a representative three-lobe cam portion has three equal sides, each having a substantially flat, low-friction surface 42A. The cam portion 42 is rotatable in the direction of arrow C in response to rotation of a shaft 69 passing therethrough. The shaft 69 may be driven via a valve-train camshaft (not shown) of engine 12 (see FIG. 1), or alternately via a separate chain-driven "stub shaft" in the valley of a V-engine.

The HP pump assembly 24A is in fluid communication with the tank 15 (see FIG. 1) through fuel line 11L. Low-pressure fuel 19L supplied through the fuel line 11L is fed into the pump bushing 50 through inlet port 80 via an inlet control valve 72. Likewise, an outlet port 81 of the pump bushing 50 is positioned to allow pressurized fuel 19H to escape the upper chamber 51A through an outlet valve 71. The outlet valve 71 is operable for actuating or opening in response to a low differential pressure across the outlet valve 71, for example approximately 2-3 bar.

Pressurized fuel 19H passing through the outlet valve 71 enters the high-pressure fuel line 11H, which is in fluid communication with the fuel rail 16 and, ultimately, the fuel injectors 16A (see FIG. 1). A separate pressure relief channel 58 is in fluid communication with the fuel line 11L and an outlet side 71B of the inlet valve 72, with a pressure relief valve 70 positioned within relief channel 58. Relief valve 70 is configured to actuate or open in response to a relatively high pressure of approximately 200 to 225 bar in one embodiment, although lower or higher pressures may be used as desired within the scope of the invention. Relief valve 70 thus provides a high-pressure return loop suitable for returning a portion of the pressurized fuel 19H back to the fuel line 11L in the direction of arrow D, through the open inlet valve 72, as described later hereinbelow.

Figure 4A:
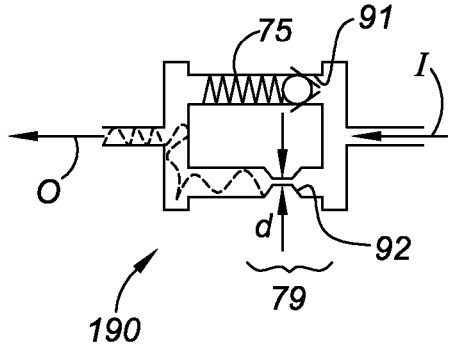
FIG. 4A is a schematic fragmentary cross sectional illustration of a portion of an alternate embodiment of the HP fuel assembly of FIG. 4.

A double-action configuration is shown in phantom in FIG. 2, as well as in the embodiments of FIGS. 3, 4, and 4A, wherein a transfer channel 61B may be placed in fluid communication with the fuel line 11L and the lower chamber 51B, with the lower chamber 51B being defined by the cylindrical wall 59 and an underside 48A of the plunger 48. Regardless of whether a single-action or double-action configuration is utilized, the HP fuel pump assembly 24A operates as a "demand" style pump as described previously hereinabove. In either the single-acting or the double-acting configuration of HP pump assembly 24A, only one fuel feed line, i.e. fuel line 11L, is provided for feeding or directing the fuel 19L from the tank 15 (see FIG. 1) to the HP fuel pump assembly 24A.

As the HP fuel pump assembly 24A does not utilize a separate return line back to the tank 15 (see FIG. 1) as noted above, some amount of fuel 19H may be displaced back through the inlet valve 72 and toward the tank 15 (see FIG. 1) at certain times during which the inlet valve 72 remains open. This displacement of fuel 19H may potentially cause perceptible back-flow pulsations, represented by arrows E, to propagate out from the pump busing 50 of the HP fuel pump assembly 24A and toward the tank 15.

Still referring to FIG. 2, when a measured pressure at the fuel rail 16 (see FIG. 1) drops below a threshold level, such as may be measured or determined by one or more of the pressure sensors 18 (see FIG. 1), a signal from the controller 17 closes the inlet valve 72. The closing of inlet valve 72 must be timed to occur somewhere along the pressurization stroke of the plunger 48, i.e. motion in the direction of arrow A. Inlet valve 72 is adapted or configured to ensure that, once the solenoid 56 closes the inlet valve 72, the rapidly increasing pressure within the upper pressure chamber 51A holds the inlet valve 72 in a closed position. The inlet valve 72 cannot then subsequently reopen until the plunger 48 is at the top dead center (TDC) position of its stroke. At this point, with pressurized fuel 19H having been discharged through the outlet valve 71, the residual pressure remaining within the upper pressure chamber 51A is minimal, and the solenoid 56 may then re-open the inlet valve 72.

Closing of the inlet valve 72 may occur anywhere from a bottom position, i.e. a bottom dead center (BDC) position, of the plunger 48, to any point along the upstroke path in the direction of arrow A during a pressurization stroke. The closing point of the inlet valve 72 is also known as the "delivery angle" or "cam angle". For the three-lobe cam as shown in FIG. 2, maximum delivery of fuel 19H occurs at a delivery angle of 60°. At this point, the inlet valve 72 closes and fuel 19H is ultimately discharged into fuel rail 16 (see FIG. 1) with minimal unused or "wasted" fuel.

However, at delivery angles less than 60°, pressure development within upper pressure chamber 51A becomes very rapid. For example, in less than 1 millisecond the pressure formed in the upper pressure chamber 51A can rapidly increase to approximately 150 bar or higher. As the delivery angle is lowered from 60° during periods of reduced fuel demand, inlet pulsations (arrows E) may progressively increase. Such pressure pulsations arise from the increasing quantity of "wasted" or unused pressurized fuel 19H from the pressurization phase, which must then flow backward through the open inlet valve 72 and toward the tank 15 (see FIG. 1). Accordingly, minimization of these pulsations (arrow E) is an object of the invention.

Referring to FIG. 3, an HP fuel pump assembly 24 of the invention has a pump bushing 50 and an axis 55, as described hereinabove with reference to the HP fuel pump assembly 24A of FIG. 2. The HP fuel pump assembly 24 of the invention is a double-acting, returnless pump style to further minimize and/or isolate the pulsations (arrow E), and therefore includes the transfer channel 61B in fluid communication with the fuel line 11L and chambers 51A, 51B. A check valve 75, i.e. a one-way valve configured for actuating or opening in response to a predetermined threshold pressure, has an inlet 75A and an outlet 75B that is positioned within the fuel line 11L to inhibit pulsations (arrow E) from passing the check valve 75 toward tank 15 (see FIG. 1). Inlet 75A is in fluid communication with the fuel line 11L, and the outlet 75B is in fluid communication with the pump bushing 50 via the inlet channel 61A.

In this manner, any "wasted", unused, or uncompressed fuel will exchange or shuttle internally between the upper and lower chambers 51A and 51B, respectively, as represented by the arrow F of FIG. 4, thus causing pulsations (arrow E) to remain isolated within the pump bushing 50 and not to propagate toward the tank 15 (see FIG. 1). High-pressure relief or bypass is provided in this embodiment by the relief valve 70, as described above with reference to FIG. 2, with an inlet 70A of the relief valve 70 being in fluid communication with an outlet 71B of the outlet valve 71. However, in the embodiment shown in FIG. 3, the outlet side 70B of the relief valve 70 is in fluid communication with the fuel line 11L and an inlet side 75A of the check valve 75. The relief valve 70 is configured to open only in response to a pressure spike or pulsation exceeding a threshold, which is approximately 200 to 225 bar in one embodiment, although those skilled in the art will recognize that the relief valve 70 may be configured to open in response to any desired amplitude of pulsation. Such a transient pressure spike may be sufficiently attenuated by an appropriately selected extended length "x" of the relief channel 58 on the outlet side 70B.

Referring to FIG. 4, an alternate HP fuel pump assembly 24B includes a hydraulic pressure "snubber" device 90 in fluid communication with HP pump fuel assembly 24A (see FIG. 2), with the snubber device 90 positioned at least partially externally to the HP pump fuel assembly 24A and in fluid communication with fuel line 11L. The snubber device 90 includes an inlet side 90A and an outlet side 90B, with the outlet side 90B in fluid communication with inlet channel 61A. External positioning with respect to the pump bushing 50 may facilitate aftermarket use with a prior installed pumping system such as HP fuel pump assembly 24A without requiring potentially expensive and difficult aftermarket reconfiguration of the pump bushing 50.

The snubber device 90 includes a check valve 75 as described above disposed within an upper fluid channel 91, and a high-pressure relief valve 78 disposed within a lower fluid channel 92, with the fluid channels 91 and 92 positioned in parallel as shown in FIG. 4. Relief valve 78 is configured to actuate or open in response to a relatively high pressure of approximately 100 bar applied at the inlet side 90A. In this manner, pulsations (arrows E) are "snubbed" or retained within the pump bushing 50 and thus prevented from propagating back toward the tank 15 (see FIG. 1) through the fuel line 11L.

Referring to FIG. 4A, an alternate hydraulic snubber device 190 includes a control orifice 79 positioned within the fluid channel 92 in place of the high-pressure relief valve 78 of FIG. 4. Fluid channel 92 may be external to the check valve 75, or may be formed integrally with the check valve 75, such as within a valve seat portion (not shown) of check valve 75, to provide a calibrated or controlled leak rate. In one embodiment, the control orifice 79 has a diameter "d" of approximately but not limited to 0.4 to 0.6 millimeters, with other orifice sizes also being useable within the scope of the invention. The diameter (d) or the equivalent flow area provided thereby may be selected to allow pulsations (arrows E of FIG. 4) of a certain amplitude to pass through the control orifice 79 while effectively blocking any such pulsations exceeding a predetermined threshold.

While the best modes for carrying out the invention have been described in detail, those familiar with the art to which this invention relates will recognize various alternative designs and embodiments for practicing the invention within the scope of the appended claims.

The invention claimed is:

1. A fuel pump assembly comprising:

a pump bushing containing a dual-chambered pumping cavity that is in fluid communication with a supply of fuel;

a first fluid channel connecting a first chamber and a second chamber of the dual-chambered pumping cavity, the first fluid channel allowing an unused portion of the supply of fuel to shuttle between the first chamber and the second chamber;

a plunger disposed within the pump bushing and having a primary axis of motion, wherein movement of the plunger in one direction along the primary axis of motion defines an intake stroke of the fuel pump assembly, and wherein movement of the plunger in another direction along the primary axis defines a pressurization stroke of the fuel pump assembly;

a plurality of fluid control valves including:

a first check valve adapted for inhibiting propagation of a pressure pulsation from the pump bushing to the supply of fuel, wherein the first check valve has an inlet side that is oriented toward the supply of fuel and an outlet side that is oriented toward the first chamber and the second chamber, and wherein the first check valve is adapted to close during the pressurization stroke;

a second check valve having an inlet side that is oriented toward the first chamber and an outlet side that is oriented toward a high-pressure fuel line, the second check valve being adapted to open during the pressurization stroke; and an inlet valve adapted for selectively admitting fuel from the first check valve into the first chamber during the intake stroke;

and a second fluid channel connecting the outlet side of the second check valve with the inlet side of the first check valve.

2. The fuel pump assembly of claim 1, wherein the plurality of fluid control valves includes a pressure relief valve disposed in the second fluid channel and having an inlet side oriented toward the outlet side of the second check valve, and having an outlet side oriented toward the inlet side of the first check valve, the pressure relief valve being configured for opening in response to a threshold pressure to thereby directly connect the outlet side of the second check valve to the supply of fluid.

3. The fuel pump assembly of claim 2, wherein the threshold pressure is approximately 200 to 225 bar.

4. The fuel pump assembly of claim 1, wherein the plurality of fluid control valves includes a control orifice.

5. The fuel pump assembly of claim 4, wherein the control orifice has a diameter of approximately 0.4 to 0.6 millimeters.

6. A fuel pump assembly comprising:

a pump bushing defining a dual-chambered pumping cavity the dual-chambered pumping cavity including a first chamber and a second chamber;

a first fluid channel connecting the first chamber and the second chamber, thereby allowing an amount of unused fuel to shuttle between the first chamber and the second chamber;

a plunger disposed within the pump bushing and having a primary axis, the plunger being moveable in alternate directions along the primary axis within the pumping cavity in response to a motion of an engine component, wherein movement of the plunger in one direction along the primary axis during an intake stroke of the pump assembly admits an amount of low-pressure fuel from a reservoir into the first chamber, and wherein movement of the plunger in another direction along the primary axis during a pressurization stroke of the pump assembly pressurizes the amount of the low-pressure fuel that is admitted into the first chamber;

an inlet valve operable for selectively admitting the amount of low-pressure fuel into the first chamber;

a first check valve adapted to close during the pressurization stroke;

a second check valve adapted to open during the pressurization stroke; and a second fluid channel connecting the outlet of the second check valve with the inlet of the first check valve;

wherein an inlet side of the first check valve is oriented toward the reservoir and an outlet side of the first check valve is oriented toward each of the first chamber and the second chamber, wherein the inlet side of the second check valve is oriented toward the first chamber and wherein an outlet side of the second check valve is oriented toward a high-pressure fuel line.

7. The fuel pump assembly of claim 6, further comprising a pressure relief valve disposed within the second fluid channel, and having an inlet side that is oriented toward the outlet side of the second check valve and an outlet side that is oriented toward each of the reservoir and the inlet side of the first check valve, wherein the pressure relief valve is configured to open in response to a threshold pressure.

8. The fuel pump assembly of claim 6, further comprising a third check valve having a flow path that is positioned in parallel with a flow path of the first check valve;

wherein an outlet side of the third check valve is oriented toward the reservoir, and wherein an inlet side of the third check valve is oriented toward an inlet side of the inlet valve.

9. The fuel pump assembly of claim 8, wherein the first check valve and the third check valve are externally positioned with respect to the pump bushing.

10. The fuel pump assembly of claim 8, further comprising a control orifice having a flow path that is substantially parallel to a flow path of the first check valve, wherein the first check valve and the control orifice are externally positioned with respect to the pump bushing.

11. A vehicle comprising:

a transmission;

an engine operable for combusting an amount of pressurized fuel for powering the vehicle, the engine being operatively connected to the transmission;

a high-pressure fuel line; and a fuel rail connected to the high-pressure fuel line and configured for injecting the amount of pressurized fuel into the engine;

a high-pressure fuel pump assembly operable for pressurizing an amount of fuel from a supply of fuel to produce the amount of pressurized fuel, the high-pressure fuel pump assembly having:

a plunger disposed within a dual-chambered pumping cavity of a pump bushing, the plunger and pumping cavity defining a first chamber and a second chamber;

a first fluid channel connecting the first chamber and the second chamber, thereby allowing an amount of unused fuel to shuffle between the first chamber and the second chamber;

an inlet valve for selectively admitting the amount of fuel from the fuel supply into the first chamber;

a first check valve;

a second check valve; and a second fluid channel connecting the outlet side of the second check valve with the inlet side of the first check valve;

and a low-pressure fuel line in direct fluid communication with an inlet side of the inlet valve and with the fuel supply;

wherein the first check valve has an inlet side that is oriented toward the fuel supply and an outlet side that is oriented toward each of the first chamber and the second chamber, the first check valve being configured for closing during a pressurization stroke of the plunger, and for inhibiting a pressure pulsation from propagating from within the pump bushing and back through the low pressure fuel line to the fuel supply, and wherein the second check valve is configured for closing during the pressurization stroke, the second check valve having an inlet side that is oriented toward the first chamber and an outlet side that is oriented toward the high-pressure fuel line.

12. The vehicle of claim 11, further comprising a high-pressure relief valve disposed within the second fluid channel and having an inlet side that is oriented toward an outlet port of the pump bushing, wherein the high-pressure relief valve is configured for directing a portion of the pressurized supply of fuel directly to the fuel supply and toward the inlet side of the first check valve when the portion of the pressurized supply of fuel exceeds a predetermined threshold pressure.

13. The vehicle of claim 12, wherein the predetermined threshold pressure is approximately 200 to 225 bar.

14. The vehicle of claim 12, further comprising a pressure control valve having a flow path positioned in parallel with a flow path of the first check valve, wherein an outlet side of the high-pressure relief valve is in fluid communication with an inlet side of the pressure control valve.

15. The vehicle of claim 14, wherein the pressure control valve includes one of: a third check valve and a control orifice.

16. The vehicle of claim 15, wherein the pressure control valve and the first check valve are positioned externally with respect to the pump bushing.

17. The fuel pump assembly of claim 1, wherein the inlet valve includes a solenoid device configured to close the inlet valve during the pressurization stroke.

18. The fuel pump assembly of claim 1, wherein the fuel pump assembly is characterized by an absence of a dedicated return line between the pump bushing and the supply of fuel.

* * * * *